US008256344B2

(12) United States Patent
Bolza-Schünemann

(10) Patent No.: US 8,256,344 B2
(45) Date of Patent: Sep. 4, 2012

(54) METHODS FOR CONTROLLING BOTH A FIRST ROLL, WHICH TAKES UP A DAMPENING AGENT FROM A DAMPENING AGENT SOURCE, AS WELL AS A SECOND ROLL, AND DAMPENING SYSTEMS

(75) Inventor: Claus August Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 1473 days.

(21) Appl. No.: 10/537,783

(22) PCT Filed: Dec. 9, 2003

(86) PCT No.: PCT/DE03/04038

§ 371 (c)(1),
(2), (4) Date: Jun. 6, 2005

(87) PCT Pub. No.: WO2004/054804

PCT Pub. Date: Jul. 1, 2004

(65) Prior Publication Data

US 2006/0081139 A1 Apr. 20, 2006

(30) Foreign Application Priority Data

Dec. 13, 2002 (DE) ..... 102 58 326

(51) Int. Cl.
*B41L 23/02* (2006.01)

(52) U.S. Cl. ..... 101/148

(58) Field of Classification Search ..... None
See application file for complete search history.

(56) References Cited

U.S. PATENT DOCUMENTS

| | | | | |
|---|---|---|---|---|
| 3,168,037 | A | 2/1965 | Dahlgren | |
| 3,688,694 | A * | 9/1972 | Preuss et al. | 101/148 |
| 3,986,452 | A | 10/1976 | Dahlgren | |
| 4,895,070 | A | 1/1990 | Bird | |
| 4,991,502 | A | 2/1991 | Akao | |
| 5,101,724 | A * | 4/1992 | D'Heureuse et al. | 101/148 |
| 5,191,835 | A | 3/1993 | Blanchard | |
| 5,909,707 | A | 6/1999 | Gagne et al. | |
| 6,138,563 | A * | 10/2000 | Sone et al. | 101/147 |
| 6,314,878 | B1 * | 11/2001 | Wolff et al. | 101/147 |

FOREIGN PATENT DOCUMENTS

| | | |
|---|---|---|
| DE | 29 27 127 | 1/1981 |
| DE | 29 32 105 | 2/1981 |
| DE | 29 32 105 C2 | 8/1982 |
| DE | 38 32 527 C2 | 9/1993 |
| DE | 299 00 216 U1 | 5/1999 |
| EP | 0 022 191 A1 | 1/1981 |
| EP | 0 893 251 A2 | 1/1999 |
| ER | 0 462 490 A1 | 12/1991 |
| JP | 56-11257 | 2/1981 |

(Continued)

*Primary Examiner* — Joshua D Zimmerman
(74) *Attorney, Agent, or Firm* — Mattingly & Malur, P.C.

(57) ABSTRACT

A first roller, which takes up dampening fluid from a dampening agent reservoir, and a second roller, are controlled. The first roller transfers the dampening fluid to the second roller. The first roller and the second roller have separate driving devices and their individual surface velocities differ from each other because of their separate driving devices. A change in the velocity of a form cylinder results in a change in the slip between the first and second rollers. Dampening systems are also contemplated.

20 Claims, 2 Drawing Sheets

FOREIGN PATENT DOCUMENTS

| | | | |
|---|---|---|---|
| JP | 1232045 | A | 9/1989 |
| JP | 01232045 | A | 9/1989 |
| JP | 4232744 | A | 8/1992 |
| JP | 11077954 | A | 3/1993 |
| JP | 9-11435 | | 1/1997 |
| WO | WO 03/039873 | A1 | 5/2003 |

* cited by examiner

METHODS FOR CONTROLLING BOTH A FIRST ROLL, WHICH TAKES UP A DAMPENING AGENT FROM A DAMPENING AGENT SOURCE, AS WELL AS A SECOND ROLL, AND DAMPENING SYSTEMS

CROSS-REFERENCE TO RELATED APPLICATIONS

This patent application is the U.S. national phase, under 35 USC 371, of PCT/DE2003/004038, filed Dec. 9, 2003; published as WO 2004/054804 A1 on Jul. 1, 2004, and claiming priority to DE 102 58 326.9 filed Dec. 13, 2002, the disclosures of which are expressly incorporated herein by reference.

FIELD OF THE INVENTION

The present invention is directed to methods for controlling a first roller, which takes up a dampening agent from a dampening agent source, and a second roller and to dampening units. The rollers are part of a roller train which is used for conveying the dampening fluid to the forme cylinder.

BACKGROUND OF THE INVENTION

A dampening unit is known from U.S. Pat. No. 3,168,037. Either a fountain roller, which takes up the dampening agent from a dampening agent reservoir, or a transfer roller which is rolling off on the fountain roller, are driven by a controllable drive mechanism in such a way that a rotating speed of these two rollers can be changed. However, the magnitude of the rotating speed of these two rollers is always identical.

A dampening unit is known from U.S. Pat. No. 3,986,452. A fountain roller, taking up a dampening agent from a dampening agent reservoir, and at least one further roller, which is in roller-to-roller contact with the fountain roller, have controllable drive mechanisms, each of which drive mechanisms is independent of the other. This further roller is in a roller-to-roller contact with a dampening agent application roller that is placed against a forme cylinder. A traversing bridge roller is placed against the dampening agent application roller.

A dampening unit, with a fountain roller taking up a dampening agent from a dampening agent reservoir and with a slip roller rolling off on the fountain roller, is known from EP 0 893 251 A2. Both rollers can be driven by separate drive mechanisms, if required. Both rollers always have the same surface speed.

A film-type dampening unit for rotary printing presses is known from EP 0 462 490 A1. In a roller train extending from a dampening agent tank as far as the forme cylinder and consisting of three or four rollers, a fountain roller and a metering roller are driven together by a first electric motor. A dampening agent distribution roller following the metering roller in the roller train is additionally moved axially back and forth by a mechanism. A bridge roller is placed against a dampening agent application roller which is placed against the dampening agent distribution roller and the forme cylinder.

A dampening unit of an offset rotary printing press is known from DE 29 32 105 C2. The dampening unit has a roller train, consisting of three rollers, extending from the dampening agent pick-up up to the forme cylinder. Each one of the three rollers is driven independently of each other by a controllable electric motor, each of which controllable electric motor preferably can be set in an infinitely variable manner.

A drive mechanism for the dampening unit of an offset printing press is known from DE 38 32 527 C2. A traversing bridge roller is provided, which is simultaneously placed against a dampening agent application roller and an ink application roller. The bridge roller is pneumatically driven. Its number of revolutions is controlled by changing the pneumatic pressure.

A dampening unit for a printing press is known from DE 299 00 216 U1. A first roller, which takes up a dampening agent, and a second roller, which is connected with the first roller for transferring dampening agent, are provided. Both of these rollers are rotatably driven. A slippage between the two rollers exists, which slippage can be set by a control device when the dampening unit is operated.

Drive mechanisms for a printing group are known from WO 03/039873 A1. The rotatory driving device and the traversing driving device of a roller are arranged on opposite ends of the roller.

A dampening unit of an offset rotary printing press is known from JP-A-01 232 045. The dampening unit has a roller train consisting of three rollers that are positioned extending from the dampening agent pick-up up to the forme cylinder. The fountain roller, which is the first roller, as well as the transfer roller which is the second roller are driven independently of each other, each by a controllable motor.

SUMMARY OF THE INVENTION

The object of the present invention is directed to providing a method for controlling a first roller, which takes up a dampening agent from a dampening agent source, and a second roller.

In accordance with the present invention, the object is attained by the provision of a roller train that conveys dampening fluid from a source of dampening fluid to a forme cylinder in a printing press. The roller train includes at least first and second rollers, the first of which contacts the dampening fluid and the second of which is in contact with the first. Each of these at least two rollers has its own separate drive motor. The first and second rollers are a roller train that may include other rollers which may also have their own drive sources. Surface speeds of the at least first and second rollers may be different from each other.

The advantages to be gained by the present invention lie, in particular, in that the first or fountain roller and an adjacent second dampening agent transfer roller can be controlled completely independently of each other. The slippage that is formed between them, because of an intentional difference in their surface speeds, is adjustable as may be needed, for accomplishing a correct metering of a dampening agent which is to be applied to the rollers. The adjustment of the slippage takes place, in particular, as a function of a change of the surface speed of the forme cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
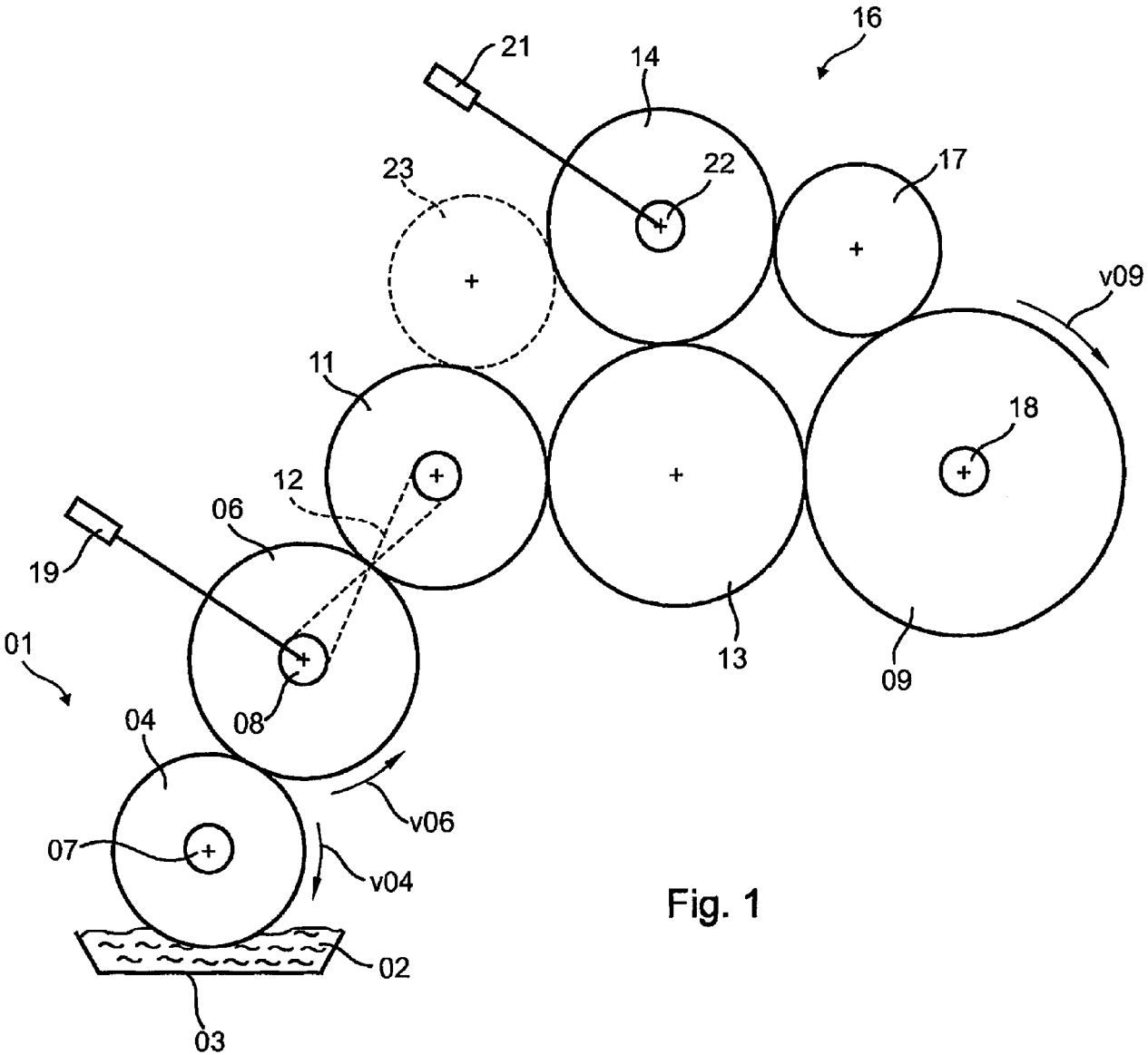
FIG. 1, a dampening unit with four rollers in a roller train extending to the forme cylinder in accordance, with the present invention, and in FIG. 2, a dampening unit with three rollers in a roller train extending to the forme cylinder also in accordance with the present invention.
Figure 2:
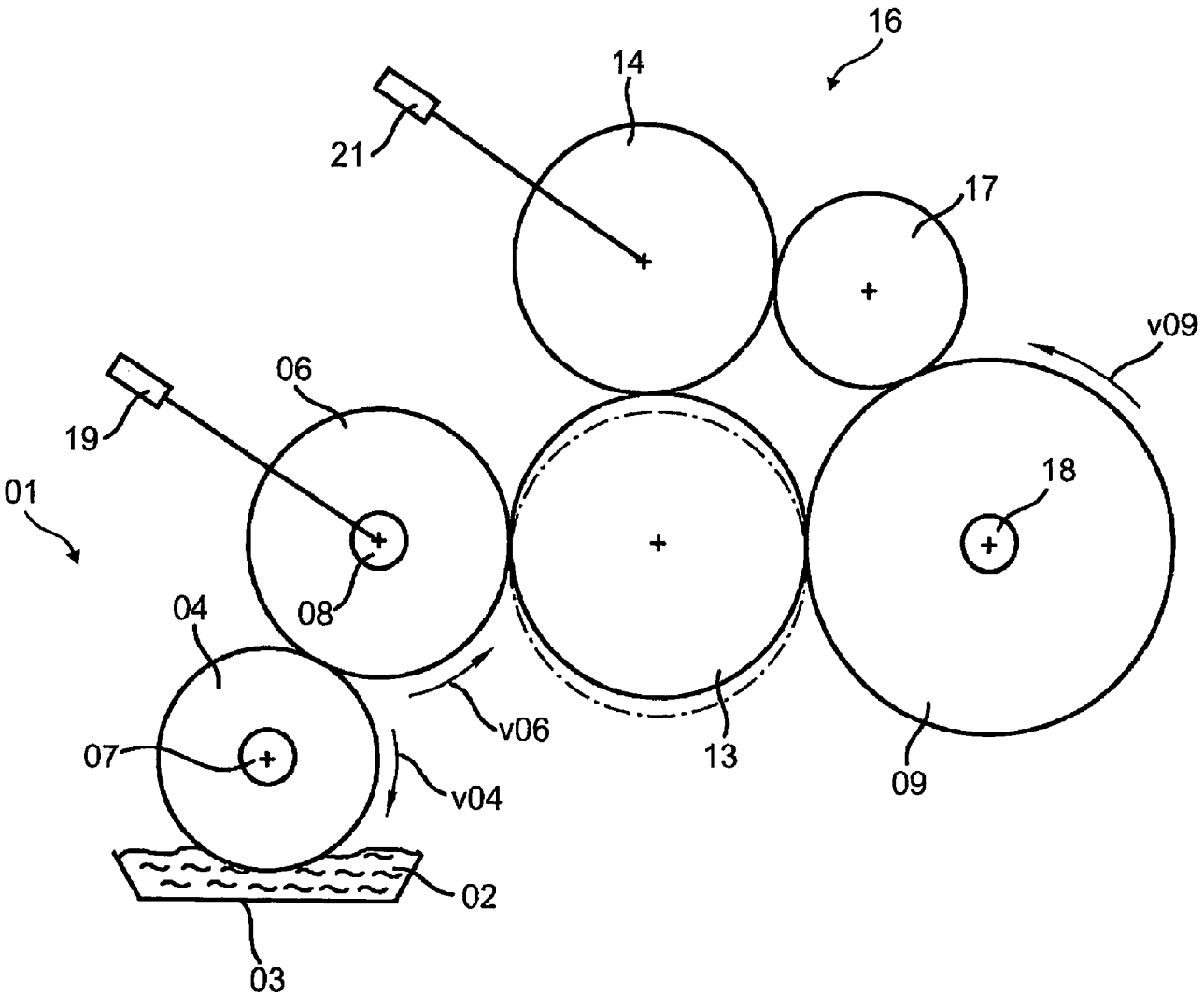

In somewhat schematic representations, FIGS. 1 and 2 each show a dampening unit 01, preferably a film-type dampening unit 01 in accordance with the present invention and, with a first roller 04 and a second roller 06. The first roller 04 takes up a dampening agent 02, such as, for example, water 02 or an alcohol-water mixture 02 from a dampening agent source 03, such as, for example, a dampening agent reservoir 03, and, in particular, a dampening agent tank 03, or from a dampening agent trough 03. The first roller 04 transfers at least a portion of the dampening agent 02 directly to the second roller 06, which is arranged adjacent to the first roller 04. Therefore, the first roller 04 is preferably embodied as a fountain roller 04 or as a duct roller 04. Alternatively, the dampening agent source 03 can be embodied as, for example, a spray crosspiece 03 with a least one spray nozzle 03, which sprays the dampening agent 02 onto the first roller 04, and wherein the dampening agent 02 is now applied to the first roller 04 in the form of finely distributed droplets. Further possible configurations provide for embodying the dampening unit 01 as a brush dampening unit or as a centrifugal dampening unit, with which the dampening agent 02 is also applied to the first roller 04 in a contactless manner. The second roller 06 can be a metering roller 06, a dampening agent transfer roller 06 or a distribution roller 06, each one of which is preferably provided with a chrome-plated surface, or with a ceramic-coated surface. The first roller 04 is the first of several rollers in a roller train, over which the dampening agent 02 is conveyed from the dampening agent reservoir 03 to the forme cylinder 09 of a printing press operated by the offset printing process, to which the dampening unit 01 has been assigned. The two embodiments of the present invention, as depicted in FIGS. 1 and 2, differ, in particular, in the number of rollers which are arranged in the roller train.

The printing press is configured as, for example, a jobbing printing press. Its printing group has at least one forme cylinder 09 and one transfer cylinder, which is not specifically represented, and wherein these two cylinders roll off on each other. A jobbing printing press, and preferably a jobbing printing press which is operating using the offset printing method, is understood to be a printing press with a forme cylinder 09, wherein only a single printing forme is arranged on its forme cylinder 09 in the axial direction of the forme cylinder, wherein the printing forme preferably has several print image locations in a direction extending axially in respect to the forme cylinder 09, and wherein the print image locations are not in a predetermined format, so that these print image locations can have any arbitrary width within defined limits, in particular in a direction extending axially with respect to the forme cylinder 09.

To attain a good printing result, dampening units 01, which use a dampening agent 02 to which dampening agent 02, for example for reducing environmental stress or for the reduction of its cost, preferably no alcohol at all, or only very little alcohol and, in particular isopropyl alcohol (IPA) of clearly less than 5% of the volume of all the matter added to the dampening agent 02 as a whole has been added, require a very precise setting of the amounts of dampening agent 02. This precise setting of the amount of dampening agent 02 is matched to the respective production speed of the printing press and to the amount of dampening agent 02 that is to be conveyed to the forme cylinder 09 during the production of the printing press, i.e. while it is printing. To make matters worse, it is necessary to accomplish an increasingly higher production speed of the printing presses. Today's printing presses easily attain a production speed of their printing group cylinders in the range of 70,000 to 80,000 revolutions per hour. If the diameters of the transfer cylinders and of the forme cylinders 09, which are in operative contact with each other, are identical, the production speed of the printing press corresponds to the surface speed v09 of the forme cylinder 09. The dampening unit 01, with the characteristics which will be described in what follows, assures the transport of a sufficient amount of dampening agent 02, which amount can be exactly metered, even at such high production speeds.

Furthermore, the amount of the dampening agent 02 which is required at the forme cylinder 09 for attaining good printing results is a function of the emulsification properties of the ink used and of the amount of ink required for producing the printed product. The ink and the dampening agent 02 form a mixture in which depending on the condition of the ink, a volumetric portion of the amount of the dampening agent 02, which can be varied within defined limits, can be mixed together with the ink. The ink switched back into the dampening unit 01 can absorb the dampening agent 02 in amounts between 15% and 25%, for example. The amounts absorbed increase with an increase in the surface speed v09 of the forme cylinder 09. However, a threshold value for the amount of dampening agent 02 emulsified by the ink is set because, for example, the ink which is imprinted on a material to be imprinted, such as, for example, a paper web, must dependably dry in the course of the passage of the material to be imprinted through a drying unit, such as, for example, a headset dryer, which is arranged downstream of the printing group. Because of the desired high production speed of the printing press, of 12 m/s or more, the retention time of the material to be imprinted in the drying unit is very short.

The more colored print image locations a printed product has, the more ink is needed at the forme cylinder 09. Accordingly, to set a required balance between ink and dampening agent 02, it is also necessary, in such a case, to make available a greater amount of dampening agent 02 at the forme cylinder 09 if a more color-intensive printed product is produced by the printing press. Therefore, to obtain a satisfactory printing result, the dampening unit 01, with the characteristics to be described in what follows, matches the amount of dampening agent 02 made available at the forme cylinder 09 also as a function of the condition of the ink and as a function of the amounts of the ink required for the printed product to be formed.

In order to make possible an adaptation of the requirements of the amounts of dampening agent 02 made available at the forme cylinder 09, as a function of the production speed of the printing press and as a function of the balance between ink and dampening agent 02 to be set, the first roller 04 and the second roller 06 have separate drive mechanisms 07, 08, which can be controlled independently of each other. Drive mechanisms 07, 08 for the first roller 04 and for the second roller 06 respectively, which drive mechanisms 07, 08 can be controlled independently of each other, have the advantage that a surface speed v04 of the first roller 04, as generated by the drive mechanism 07, and a surface speed v06 of the second roller 06, as generated by the drive mechanism 08, do not rigidly follow a parameter affecting the amount of dampening agent 02. Instead, for accomplishing a matching of the amounts of dampening agent 02 to be conveyed, the ratio of the surface speeds v04, v06 with respect to each other, can also be variably set according to the requirements, by which variation the metering of the dampening agent 02 to be conveyed by the dampening unit 01 is considerably affected. As a function of the actually existing printing process, and for the same value of the surface speed v09 of the forme cylinder 09, different settings of the surface speed v04 of the first roller 04 and of the surface speed v06 of the second roller can result, as well as differences regarding their ratio with respect to each other.

As a rule, the surface speed v04 of the first roller 04, as generated by the first drive mechanism 07, and the surface speed v06 of the second roller 06, as generated by the second drive mechanism 08 are different from each other. Preferably, the surface speed v04 of the first roller 04 is less than the surface speed v06 of the second roller 06. The surface speeds v04, v06 can be set independently of each other and can both be set variably. In a preferred embodiment of the present invention, the surface speed v06 of the second roller 06 lies, for example, between twice and four-and-a half times, and in particular is three times that of the surface speed v04 of the first roller 04. The magnitude of the surface speed v04 of the first roller 04 is limited by the requirement that the first roller 04 must dependably pick up the dampening agent 02 out of the dampening agent reservoir 03 on its surface. Experience has shown that, at a surface speed v04 of the first roller 04, starting at more than 2 m/s, the dependable pickup of dampening agent 02 is no longer assured. At surface speeds above that value, considerable amounts of the dampening agent 02 are flung off the surface of the first roller 04. Therefore, the surface speed v04 of the first roller 04 is preferably set to values which are lower than its upper limit speed, such as, for example, to a value of at most 1.5 m/s. In contrast to this, the surface speed v09 of the forme cylinder 09 lies in a range of 12 m/s to 15 m/s, for example.

If the surface speed v06 of the second roller 06 is greater than the surface speed v04 of the first roller 04, which as a rule, is the case, a slippage exists between the first roller 04 and the second roller 06, because the surface speed v04 of the first roller 04 lags behind the surface speed v06 of the second roller 06. This slippage, which is formed by a ratio of the two surface speeds v04, v06 of the two rollers 04, 06, can be variably set by the use of the drive mechanisms 07, 08 of the first roller 04 and of the second roller 06, which drive mechanisms 07, 08 are independent of each other.

The amount of dampening agent 02 which is to be conveyed by the roller train of the dampening unit 01 must be adjusted as a function of a change of the surface speed v09 of the forme cylinder 09 which is driven by a further, separate drive mechanism 18, such as, for example, when increasing the surface speed v09 of the forme cylinder 09, for example when increasing the surface speed v09 from a set-up speed of the printing press to its production speed. For example, the set-up speed of the printing press lies between 1.7 m/s and 3.4 m/s, and preferably lies between 2 m/s and 2.6 m/s, and therefore amounts to between 11% and at most to 25% of the production speed of the printing press, or the surface speed v09 of the forme cylinder 09. Thus, to reach the production speed, the surface speed v09 of the forme cylinder 09 is increased by a magnitude of between four times to nine times, starting from the set-up speed. A rapidly reacting dampening system unit 01, which can be matched to the requirements of the dampening agent 02 to be conveyed, is therefore required for such a large increase in speed. In the same way, the conveyed amount of dampening agent 02 must also be adjusted during a period of start-up of the printing press from its stopped state, or when the production speed is being reduced. Moreover, as previously mentioned, the actual requirement for dampening agent 02 is a function of the amount of ink needed for the production of the printed product. In many cases of application, and in particular in connection with printing presses with a large increase in speed, a sufficient reaction to this matching requirement is not always possible with a rigid coupling, such as, for example, with a gear coupling between the first roller 04 and the second roller 06.

To provide the required matching, the number of revolutions of the drive mechanisms 07, 08 of the first and second rollers 04, 06, respectively of the dampening unit 01 are controllable, and preferably are infinitely variably controllable, and in particular are electronically controllable. Control of the numbers of revolution can be performed remotely, such as, for example, from a control console that is assigned to the printing press. The drive mechanisms 07, 08 for the first roller 04 and for the second roller 06, respectively are preferably embodied as electric motors 07, 08, such as, for example, a.c. or d.c. motors 07, 08, or as frequency-controlled, multiphase a.c. motors 07, 08. The drive mechanism 18 of the forme cylinder 09 can also be embodied as an electric motor 18, such as, for example, an a.c. or a d.c. motor 18 or as a frequency-controlled multiphase a.c. motor 18. In a manner that is the same as the drive mechanisms 07, 08 of the rollers 04, 06 of the dampening unit 01, this motor 18 can also be controllable. The drive mechanism 18 of the forme cylinder 09 is independent of the drive mechanisms 07, 08 of the rollers 04, 06 of the dampening unit 01. There is no positive connection between the drive mechanisms 07, 08 of the rollers 04, 06 and the drive mechanism 18 of the forme cylinder 09. It is not a requirement that the drive mechanism 18 of the forme cylinder 09 only drives the forme cylinder 09. The drive mechanism 18 can transfer the torque it has generated at least to the forme cylinder 09, and possibly also to the transfer cylinder, which is not specifically represented, and which works together with the forme cylinder 09.

If required, the control device for the drive mechanisms 07, 08, 18 can be expanded into a regulating device by adding a positive feedback device, that is picking up an actual value, and an evaluation device for evaluating a feed-back signal. The actual value of a number of revolutions of the rollers 04, 06 or of the forme cylinder 09 is detected, for example, by the use of a sensor which is providing an electrical output signal. The control or the regulation of the drive mechanisms 07, 08 is preferably performed with the aid of a suitable computing unit which is not specifically represented, and which, for example, predetermines a corridor for advantageous setting values.

The first roller 04 and the second roller 06 of the dampening unit 01 constitute the first and second rollers in the roller train that is conveying the dampening agent 02 to the forme cylinder 09. The surface speed v04 of the first roller 04 and the surface speed v06 of the second roller 06 can be set independently of each other and each without a rigid dependence on the surface speed v09 of the forme cylinder 09. As a rule, the surface speed v04 of the first roller 04, or the surface speed v06 of the second roller 06 are both less than the surface speed v09 of the forme cylinder 09.

In a first operating state of the dampening unit 01, it is possible to provide an operating mode so that the surface speed v09 of the forme cylinder 09 and the surface speed v06 of the second roller 06 are at a first ratio with respect to each other, while in a second operating state of the dampening unit 01, the surface speeds v09, v06 are at a second ratio with respect to each other. The surface speed v09 of the forme cylinder 09 can have the same value during both of the operating states of the dampening unit 01, or alternatively can assume values which differ from each other.

The roller train to the forme cylinder 09 can be expanded by the addition of a third roller 11, or also by the addition of a fourth roller 13, wherein the third roller 11 is placed downstream of the second roller 06 and the fourth roller 13 is placed downstream of the third roller 11. The third roller 11 is coupled, for example by the use of a set of gears 12, such as, for example, a gear wheel drive 12 or a belt drive 12, with the second roller 06. Alternatively, driving of the third roller 11 can take place by friction, for example at the second roller 06, or by friction with the forme cylinder 09. The surface speeds of the several rollers provided in the roller train extending from the dampening agent reservoir 03 to the forme cylinder 09 has been respectively set in such a way that there is slippage between the second roller 06 and the third roller 11, or between the third roller 11 and the fourth roller 13. The slippage between the first roller 04 and the second roller 06 can be, for example, 1:3, wherein the first roller 04 rotates slower than the second roller 06. The slippage between the second roller 06 and the third roller 11 can be selected to be considerably greater, wherein, for example, the third roller 11 rotates very much faster than the second roller 06.

For accomplishing an improved distribution of the dampening agent 02 on the surfaces of the rollers 06, 11, 13 which are arranged in the roller train, and for preventing patterning, at least one of these rollers 06, 11, 13, which follow the first roller 04 in the roller train, can be embodied to also perform traversing movements. It is advantageous to decouple or to separate the traversing drive mechanism 19 provided for this purpose from the rotatory drive mechanisms 07, 08 of the rollers 06, 11, 13 and to configure it to be controllable independently of the latter. The frequency of the traversing movement, in particular, can be freely selected. The length of the traversing movement is for example ±8 mm. However, it is also possible to provide a variably adjustable length for the traversing movement of, for example, between 0 mm and 16 mm. The traversing drive mechanism 19 is embodied, for example, as an electrical motor 19, such as, for example, a linear motor 19. The roller 11 or 13, which is transferring the dampening agent 02 to the forme cylinder 09, is, in particular, driven by friction by the forme cylinder 09.

An inking unit 16, with at least one ink application roller 17 which can be placed against the forme cylinder 09, is assigned to the forme cylinder 09. The inking unit 16 inks a printing forme, which is not specifically represented and which is mounted on the surface of the forme cylinder 09 by use of the ink application roller 17. The roller 06 or 11 or 13 which is primarily applying the dampening agent 02 to the forme cylinder 09, and, depending on the embodiment of the roller train, which is the second roller 06, the third roller 11 or the fourth roller 13, can then advantageously be placed simultaneously against the forme cylinder 09 and also against the ink application roller 17, or against an ink distribution roller of the inking unit 16 which is working together with the forme cylinder 09. The placement of the roller 06, 11 or 13, which applies the dampening agent 02 to the forme cylinder 09, against the ink application roller 17 can therefore occur either directly or can occur indirectly, for example via a bridge roller 14 which is embodied as an ink distribution roller 14. In connection with a dampening unit 01 that is configured with four rollers 04, 06, 11, 13 in the roller train in particular, it is also possible to provide a further second bridge roller 23, that is represented in dashed lines in FIG. 1 and which is placed upstream of the first bridge roller 14, wherein the upstream located bridge roller 23 is arranged between the first bridge roller 14 and the third roller 11, i.e. the roller 11 which, in the roller train, is arranged upstream of the fourth roller 13, which fourth roller 13 applies the dampening agent 02 to the forme cylinder 09. Preferably, the first bridge roller 14 is seated in a frame, which is not specifically represented, and is movable by at least one actuating device, such as, for example, by a remote-controlled working cylinder, and in particular by a pneumatic cylinder which is not specifically represented, in such a way that it can selectively assume, for example while being controlled from a control console, one of four operating positions as described in what follows. In one operating position the first bridge roller 14 is placed against the ink application roller 17 and not against the roller 06, 11 or 13 which is applying the dampening agent 02 to the forme cylinder 09. In another, second operating position, the bridge roller 14 is placed against the roller 06, 11 or 13 which is applying the dampening agent 02 to the forme cylinder 09 and not against the ink application roller 17. In a further or third operating position, the bridge roller 14 is placed simultaneously against the roller 06, 11 or 13 that is applying the dampening agent 02 to the forme cylinder 09 and also against the ink application roller 17, which is its normal operating position, and wherein the bridge roller 14 can be additionally moved into the other operating positions. The bridge roller 14 furthermore can be simultaneously removed from contact with the roller 06, 11 or 13 which is applying the dampening agent 02 to the forme cylinder 09 and from contact with the ink application roller 17. The bridge roller 14 is placed into contact if it is touching one of the rollers 06, 11 or 13 which is applying the dampening agent 02 to the forme cylinder 09, and/or if it is touching the ink application roller 17, or is at least in an operative contact with them, for conveying the ink or the dampening agent 02. It is removed out of contact if its surface does not touch the surface of one of the rollers 06, 11 or 13, or if the surfaces of the rollers 06, 11 or 13 are at least not in operative contact for conveying the ink or the dampening agent 02. The upstream positioned bridge roller 23 can also have several operating positions by being either in contact with the first bridge roller 14 or with the third roller 11 of the roller chain, or by being removed from contact with at least one of these rollers 11, 14, wherein at least one actuating device, which is not specifically represented, such as, for example, a working cylinder, and in particular a pneumatic cylinder, is provided. The actuating device moves the upstream located bridge roller 23 from one operating position into the other operating position. The operation of this actuation device can preferably also take place by remote control, and in particular can be accomplished from the control console.

Upon contact between the rollers, a flattened contact strip of a width of between 3 mm and 8 mm, and preferably of between 5 mm and 6 mm, is formed extending in the axial direction of, and between the rollers 04, 06, 11, 13 on their surfaces. The flattened contact strip between the roller 06, 11, or 13 which is applying the dampening agent 02 to the forme cylinder 09, or between the ink application roller 17 and the forme cylinder 09, can have a width of from 8 mm up to 10 mm. The contact force between the rollers 04, 06, 11, 13, 17 and the forme cylinder 09 is set, for example manually, by the use of an adjusting spindle, preferably through a path change, wherein the set width of the contact strip remains unchanged during the printing process. If the width of the contact strip is to be changeable during the printing process, it is advantageous to perform the setting of the rollers 04, 06, 11, 13, 17 by the use of a roller lock, which roller lock performs, while, for example, being remotely controlled preferably by actuation from the control console, a radial lift. As a rule, the setting of the width of the contact strip takes place independently of the surface speed v09 of the forme cylinder 09.

The bridge roller 14 is preferably structured so that it is able to perform traversing movements and is driven, for example, by a traversing drive mechanism 21, which is preferably embodied as a controllable motor 21, such as, for example, a linear motor 21, and which is preferably independently of its rotatory movement. A further drive mechanism 22 for the bridge roller 14, which is independent of the other drive mechanisms 07, 08, 18, can be provided as, for example, a motor 22, preferably an a.c. or d.c. motor 22 or a frequency-controlled multiphase a.c. motor 22, and in particular as an electrical motor 22 which can be remote-controlled.

If the roller 11 or 13, which is applying the dampening agent 02 to the forme cylinder 09, is driven by friction, this roller 11 or 13 can be seated in the frame in such a way that an axial or transverse lift or displacement of, for example, 3 mm to 4 mm, is possible. This lift or axial displacement is performed in that roller 11 or 13 is taken along by the traversing movement of the bridge roller 14. Preferably no, or only a minimal slippage of less than 2%, and preferably of less than 1%, exists between the roller 11 or 13, which is applying the dampening agent 02, and the forme cylinder 09. As an alternative to frictional driving, and in connection with special applications, it is, however, also possible to provide the roller 11 or 13, which is applying the dampening agent 02 to the forme cylinder 09, with its own drive mechanism, which is not specifically represented, for the rotatory movement, which dampening agent application roller drive mechanism is independent of the other drive mechanisms 07, 08, 18, 22, and which may be, for example a motor, and preferably may be an a.c. or a d.c. motor or a frequency-controlled multiphase a.c. current motor.

To change the dampening unit 01 between a first operating mode, for "direct dampening," and a second operating mode, for "indirect dampening," the roller 11 or 13, that is used for applying the dampening agent 02 to the forme cylinder 09, can be placed against the bridge roller 14 or can be moved away from it. For this purpose, the roller 11 or 13, which is applying the dampening agent 02 to the forme cylinder 09, which, in this case, is the roller 13, is represented in two operating positions, as is shown in FIG. 2. In the dot-dash line representation, the roller 13 has been moved away from the bridge roller 14. To move the roller 11 or 13, which is applying the dampening agent 02 to the forme cylinder 09, into its desired operating position, at least one actuating device, which is not specifically represented, and which preferably is remote-controlled, for example from the printing press control console, is provided, for example as a working cylinder, and preferably as a pneumatic cylinder. This actuating device brings the roller 11 or 13, that is applying the dampening agent 02 to the forme cylinder 09, into one of the two operating positions with respect to the bridge roller 14, or moves it away from the forme cylinder 09. The roller 11 or 13, which is applying the dampening agent 02 to the forme cylinder 09, can be seated in eccentric bushings, for example, and in which eccentric bushings the roller 11 or 13, which is applying the dampening agent 02 to the forme cylinder 09, can be moved into its desired operating position by the actuating device. The operating mode characterized as "direct dampening" is selected if the roller 11 or 13, which is applying the dampening agent 02 to the forme cylinder 09, is placed against the forme cylinder 09 and is moved away from the bridge roller 14. In this mode of operation the roller 11 or 13, which is applying the dampening agent 02 to the forme cylinder 09, only applies the dampening agent 02 to the forme cylinder 09. The mode of operation characterized as "indirect dampening" is selected if the roller 11 or 13, which is applying the dampening agent 02 to the forme cylinder 09, is simultaneously placed against both the forme cylinder 09 and the bridge roller 14. During this "indirect dampening," the roller 11 or 13, which is applying the dampening agent 02 to the forme cylinder 09, also conveys a not inconsiderable amount of ink that is coming from the inking unit 18 to the forme cylinder 09.

The first roller 04 and the second roller 06 can be moved together away from the roller 11 or 13, which is applying the dampening agent 02 to the forme cylinder 09. For this purpose, the first roller 04 and the second roller 06 can be seated in a common support, which is not specifically shown. The common support has a rotating point, around with the support can be rotated, so that the first roller 04 and the second roller 06 together pivot away from the roller 11 or 13, which is applying the dampening agent 02 to the forme cylinder 09.

The surface of the first roller 04 consists, for example, of an elastomeric material, preferably rubber, and in particular consists of a material of a hardness between 20 and 30 Shore A, and preferably of approximately 25 Shore A. The surface of the second roller 06 consists of, for example, a ceramic material or of a chromium-containing material, and where a coating of a chromium-containing material has been applied to a roller core of a metallic material, for example. The surface of the roller 11 or 13, which is applying the dampening agent 02 to the forme cylinder 09, in turn consists of, for example, an elastomeric material, preferably rubber, and in particular of a material of a hardness between 25 and 40 Shore A, and preferably of approximately 35 Shore A. The surface of the roller 11 or 13, which is applying the dampening agent 02 to the forme cylinder 09, is therefore made harder than the surface of the first roller 04. The surface of the second roller 06 is preferably selected to be very much harder, for example harder by a factor of ten, than the surface of the first roller 04 or the surface of the roller 11 or 13, which is applying the dampening agent 02 to the forme cylinder 09. The surface of the bridge roller 14 is made of a plastic material, for example, and is preferably preferably made of Rilsan. However, the surface of the upstream located second bridge roller 23 can consist of an elastomeric material, preferably of rubber.

The ratio of the surface speed of the forme cylinder 09 with respect to the surface speed of the roller 13 applying the dampening agent 02 to the forme cylinder 09; with respect to the surface speed of the third roller 11; with respect to the surface speed of the second roller 06; and with respect to the surface speed of the first roller 04 are, for example, like 1 to between 1 to 0.98; to between 0.4 to 0.98; to between 0.25 to 0.4 and to between 0.08 to 0.18, and are preferably 1 to 0.99 to 0.96 to 0.33 to 0.1. If only three rollers in the roller train between the forme cylinder 09 and the dampening agent reservoir 03 are being used, the slippage ratio, which was separately mentioned above for the third roller 11, can be omitted, because the roller 11 is now already the roller applying the dampening agent 02 to the forme cylinder 09.

While preferred embodiments of methods for controlling both a first roller, which takes up dampening agent from a dampening agent source, as well as a second roller, and dampening systems in accordance with the present invention have been set forth fully and completely hereinabove, it will be apparent to one of skill in the art that various changes in, for example, the specific structure of the printing press, the type of material to be printed, and the like could be made without departing from the spirit and scope of the present invention which accordingly is to be limited only by the appended claims.

What is claimed is:

1. A method for controlling rollers in a dampening agent application roller train of a printing unit including:

providing a source of a dampening agent;

providing a first roller having a first roller surface adapted for taking up a dampening agent from said source of dampening agent;

providing a second roller having a second roller surface contacting said first roller surface and receiving said dampening agent directly from said first roller surface;

providing a forme cylinder having a forme cylinder surface speed of rotation;

providing a forme cylinder drive motor;

using said forme cylinder drive motor and rotating said forme cylinder at said forme cylinder surface speed of rotation;

including said first and said second rollers in a roller train usable for conveying said dampening agent to said forme cylinder;

providing a first roller drive motor for driving said first roller;

rotating said first roller at a first roller surface speed using said first roller drive motor;

providing said first roller surface speed at less than 2 m/s;

providing a second roller drive motor for driving said second roller at a second roller surface speed independently of said first roller;

controlling each of said first roller drive motor, said second roller drive motor and said forme cylinder drive motor independently of each other;

rotating said second roller at said second roller surface speed, different from said first roller surface speed using said second roller drive motor;

selecting said second roller surface speed being greater than said first roller surface speed;

selecting both said first roller surface speed and said second roller surface speed being less than said forme cylinder surface speed of rotation;

setting both of said first roller surface speed and said second roller surface speed as a function of said forme cylinder surface speed;

selecting a slippage between said first roller surface and said second roller surface by said controlling of each of said first roller drive motor and said second roller drive motor independently, said selected slippage resulting from said difference between said first roller surface speed and said second roller surface speed;

controlling said selected slippage between said first roller surface and said second roller surface, using said first and second drive motors;

setting said selected slippage between said first roller surface and said second roller surface as a function of said forme cylinder surface speed; and controlling an amount of said dampening agent supplied to said forme cylinder using said roller train by controlling said selected slippage between said first roller surface and said second roller surface as said function of said forme cylinder surface speed.

2. The method of claim 1 further including selecting an ink for use in printing by said forme cylinder, forming a mixture of said ink and said dampening agent, wherein a property of said ink includes an amount of said dampening agent mixed with it and setting said one of said surface speed of at least one of said first and second rollers and said slippage between said first and second rollers as a function of said property of said ink.

3. The method of claim 1 further including selecting an amount of ink required for printing using said forme cylinder and setting said one of said surface speed of at least one of said first and second rollers and said slippage between said first and second rollers as a function of said amount of ink required.

4. The method of claim 1 further including providing a dampening unit having said dampening agent source and said roller train and operating said dampening unit selectively in one of a first operating state and a second operating state wherein in said first operating state, said surface speed of said forme cylinder and said surface speed of said second roller are in a first relation with each other and wherein in said second operating state said surface speed of said forme cylinder and said surface speed of said second roller are in a second relation with each other, said first relation and said second relation being different.

5. The method of claim 1 further including operating said second roller as a traversing roller.

6. The method of claim 1 further including providing said first and second drive motors being infinitely variably controlled.

7. The method of claim 1 further including providing said first and second drive motors being electronically controlled.

8. The method of claim 1 further including providing a control console and controlling said first and second drive motors from said control console.

9. The method of claim 1 further including providing a third roller in said roller train, locating said third roller after, in a direction of travel of said dampening agent, said second roller and providing a drive between said second roller and said third roller.

10. The method of claim 9 further including providing said drive as a gear drive.

11. The method of claim 9 further including providing said drive as a friction drive.

12. The method of claim 9 further including providing a fourth roller in said roller train and locating said fourth roller after said third roller in said direction of travel of said dampening agent.

13. The method of claim 12 further including setting a slippage between at least one of said second roller and said third roller and said third roller and said fourth roller.

14. The method of claim 1 further including bringing a last roller in said roller train into contact with said forme cylinder by contacting one of a bridge roller and an ink application roller working with said forme cylinder.

15. The method of claim 1 further including providing a dampening agent reservoir as said dampening agent source and dipping said first roller into said dampening agent reservoir.

16. The method of claim 1 further including applying said dampening agent to said first roller as finely distributed droplets.

17. The method of claim 1 further including providing a computer and changing one of said surface speed of one of said first and said second roller and said slippage between said first and second roller using said computer.

18. The method of claim 4 further including selecting a forme cylinder surface speed being the same in both of said first and second operating states.

19. The method of claim 4 further including selecting a first forme cylinder surface speed in said first operating state and a second forme cylinder surface speed, different from said first forme cylinder surface speed in said second operating state.

20. The method of claim 4 further including providing at least one third roller arranged in said roller train downstream, in a direction of travel of said dampening agent and using said third roller for applying said dampening agent to said forme cylinder.

* * * * *